US009868193B2

(12) United States Patent
Necer

(10) Patent No.: US 9,868,193 B2
(45) Date of Patent: Jan. 16, 2018

(54) HAND TOOL FOR CARRYING OUT AT LEAST SCREWING/UNSCREWING AND/OR PERCUSSION OPERATIONS ON ASSEMBLING MEANS SUCH AS SCREWS, BOLTS OR PINS

(75) Inventor: Nadir Necer, Bresles (FR)

(73) Assignee: SMOW, Bresles (FR)

( * ) Notice: Subject to any disclaimer, the term of this patent is extended or adjusted under 35 U.S.C. 154(b) by 1787 days.

(21) Appl. No.: 13/122,856

(22) PCT Filed: Oct. 14, 2009

(86) PCT No.: PCT/FR2009/001206
§ 371 (c)(1),
(2), (4) Date: Apr. 16, 2012

(87) PCT Pub. No.: WO2010/043786
PCT Pub. Date: Apr. 22, 2010

(65) Prior Publication Data

US 2012/0312131 A1 Dec. 13, 2012

(30) Foreign Application Priority Data

Oct. 14, 2008 (FR) ..... 08 05648

(51) Int. Cl.
*B25B 19/00* (2006.01)
*B25B 15/02* (2006.01)
*B25D 5/00* (2006.01)

(52) U.S. Cl.
CPC ..... *B25B 15/02* (2013.01); *B25D 5/00* (2013.01); *B25D 2250/241* (2013.01); *B25D 2250/371* (2013.01)

(58) Field of Classification Search
CPC ..... B25B 15/02; B25B 2250/241; B25B 2250/371; B25D 5/00
See application file for complete search history.

(56) References Cited

U.S. PATENT DOCUMENTS

| | | | | |
|---|---|---|---|---|
| 2,960,864 | A * | 11/1960 | Watts | H01R 43/26 173/202 |
| 4,919,216 | A | 4/1990 | Ikegami | |
| 5,321,999 | A | 6/1994 | Lin | |
| 6,250,187 | B1 | 6/2001 | Ju et al. | |
| 6,370,993 | B1 | 4/2002 | Pitstick | |
| 2003/0121681 | A1 | 7/2003 | Ju | |

FOREIGN PATENT DOCUMENTS

DE 9407315 U1 7/1994

* cited by examiner

*Primary Examiner* — David B Thomas
(74) *Attorney, Agent, or Firm* — Young & Thompson

(57) ABSTRACT

A hand tool for carrying out at least the screwing/unscrewing and/or percussion operations for boring, marking or punching, in particular on assembling means such as screws, bolts or pins. The hand tool includes at least one body attached to a handle. A tool-carrier rod is provided for carrying an impression corresponding to the operation to be carried out. An integrated means is provided for imparting an axial percussion in the direction of the tool-carrier rod. According to the invention, a shock rod is provided inside the tool-carrier rod and is capable of longitudinal movement for directly imparting the percussion force to the impression.

10 Claims, 3 Drawing Sheets

HAND TOOL FOR CARRYING OUT AT LEAST SCREWING/UNSCREWING AND/OR PERCUSSION OPERATIONS ON ASSEMBLING MEANS SUCH AS SCREWS, BOLTS OR PINS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to a handheld tool for carrying out at least the screwing/unscrewing and/or percussion operations on assembling means, such as screws, bolts or pins.

The percussion operations can be boring, marking or still punching.

2. Description of Related Art Including Information Disclosed Under 37 CFR 1.97 and 37 CFR 1.98.

Different types of screwdrivers capable of driving the screw in rotation are known for disassembling screws. When the screws have remained in place for a long time and/or when the screws are exposed to a corrosive or oxidising environment, the frictions between the thread of the screws and the internal screw thread of the orifices in which they have been placed to oppose a resisting torque which is too high to be overcome by the simple screwing torque.

In this case, a device adapted to large screws, known as impact screwdriver, is well-known, which operates with the strike of a hammer. An internal mechanism of the device transforms the shock into a rotational movement, thereby pressing the insert of the device tight against the impression of the screw, which avoids any risk of slippage. However, such device proves ill-suited for small screws.

In this context, document FR 2,720,024, or still document FR 2,764,226, disclose a handheld tool suitable for loosening small screws. This tool looks like a multipurpose screwdriver with a handle and a tool-carrier rod, in particular terminated by an insert-carrier and comprises an integrated percussion mechanism.

According to the screw to be disassembled, the operator fits the insert with the most suitable impression on the tool, then grabs the tool by its handle and locates the insert in the impression of the screw to be disassembled. To achieve the shock, he only needs to press the handle in the direction of the screw.

During this action, the tool-carrier rod penetrates in the body of the handle while compressing, via a stemming rod, a lead against a trigger spring, thereby causing the compression mechanism to arm. At the end of travel, a cam breaks up the stemming effect of the rod, thereby releasing the trigger spring which propels the lead suddenly against the inner end of the tool-carrier rod, and the shock is generated.

Document FR 2,764,226 discloses more particularly such a tool equipped, additionally, with selection means enabling to block or not the translation of the tool-carrier rod relative to the handle, so as to use the tool as a striking pin or still as a simple screwdriver.

The aim of the present invention is to provide such a tool, for disassembling assembling means, enabling in particular to disassemble small screws, with improved performance.

More particularly, the aim of the present invention is to provide a handheld tool with better transmission of the shock on the surface to be struck during percussion.

Another aim of the invention is to provide a tool whose structure enables one to dissociate the various functions such as, on the one hand, arming and unscrewing, and on the other hand, generation and transmission of shocks, for increased efficiency of the latter.

Another aim of the invention is to provide a percussion tool whose generated shock is not or practically not felt by the operator.

Another aim of the invention is to provide a handheld tool whose percussion shock intensity can be adjusted.

Another aim of the invention is to provide a tool authorizing, not only a percussion function, but also a screwing and/or unscrewing function.

Other aims and advantages of the present invention will appear in the following description which is given only by way of example and without being limited thereto.

BRIEF SUMMARY OF THE INVENTION

The invention relates to a handheld tool for carrying out at least screwing/unscrewing and/or percussion operations, in particular on assembling means, such as screws, bolts or pins. The handheld tool includes at least one body attached to a handle; a tool-carrier rod for carrying an impression corresponding to the operation to be carried out; and integrated means for imparting an axial percussion in the direction of the tool-carrier rod The integrated means include: a trigger spring and a lead, interdependent of said trigger; means for arming the lead and means for triggering the percussion.

According to the invention the means for arming the lead comprise said tool-carrier rod, provided for moving in translation relative to the body and retractable stemming means, attached, on the one hand, to said tool-carrier rod, and to said lead on the other, wherein said means for triggering the percussion comprises of means for breaking up the stemming effect at the end of travel of said tool-carrier rod and thereby release the stored energy.

Further, a shock rod is provided inside the tool-carrier rod, capable of longitudinal movement relative to said tool-carrier rod for directly imparting the percussion force to the impression, wherein said lead is capable of moving axially in translation relative to said body and relative to the shock rod, and of storing energy.

Advantageously, according to the invention, the arming function is thus fulfilled by the tool-carrier rod which is translated relative to the body for arming the lead, whereas the function of transmitting the shock to the impression is fulfilled by the shock rod which enables direct transmission of the shock to the impression, without transmitting it to said tool-carrier rod. Both functions are thus dissociated.

So as to be able to adapt to the operation to be carried out, the tool can be terminated by an impression-carrier for removable attachment of an impression.

So as to adjust the intensity of the percussion, the tool may exhibit means for adjusting the compression of the trigger spring, comprising at least one rotary knob on the rear portion of the handle.

These means for adjusting the compression of the trigger spring can include, additionally, a screw/nut system and means for guiding the nut translationally along the longitudinal axis of said at least one body, whereas the screw is interdependent of said rotary knob, for driving the nut translationally during the rotation of said knob, whereas the nut provides, directly or indirectly, a seat for the trigger spring.

So as to be able indifferently to use the handheld tool as a screwing and unscrewing means, or as a percussion means, the tool may exhibit control means for selectively blocking the tool-carrier rod in translation relative to the body, or, conversely, allowing the translation of said tool-carrier rod relative to said body, enabling selectively to use the handheld tool for screwing/unscrewing or still percussion, wherein the control means comprises at least one selection ring, in particular with an indexing function, on the front of the handle of the tool.

According to an advantageous structural embodiment of the integrated mechanism for imparting the axial percussion, the retractable stemming means may comprise a flection rod, which is rigidly nested in a bore of the lead and of an arming stop, integral with the tool-carrier rod and against which the flection rod can stem, wherein the means for breaking up the stemming effect comprises a cam formed of a washer which is attached to the body, provided for engaging at the end of travel of said tool-carrier rod, into the flection rod to make it bend and thus release the arming stop.

Advantageously, once the shock has been generated, means for recalling the tool-carrier stem can enable said rod to come back to a resting position relative to the body. These recall means may comprise a recall spring bearing, on the one hand, on the washer then acting as a cam, and on a shoulder of the tool-carrier rod, on the other hand.

According to an embodiment, the tool-carrier rod may exhibit a cylindrical end whose circular edge forms the arming stop, whereas the inner diameter of said washer causes, at the end of travel of the tool-carrier rod, said flection rod to bend inside the cylindrical portion, wherein a hammer, attached to the lead, protrudes ahead of the flection rod, is provided so as to strike the shock rod inside said cylindrical end.

BRIEF DESCRIPTION OF THE SEVERAL VIEWS OF THE DRAWINGS

The invention will be understood better when reading the following description accompanied by the appended drawings among which.

DETAILED DESCRIPTION OF THE INVENTION

Figure 1:
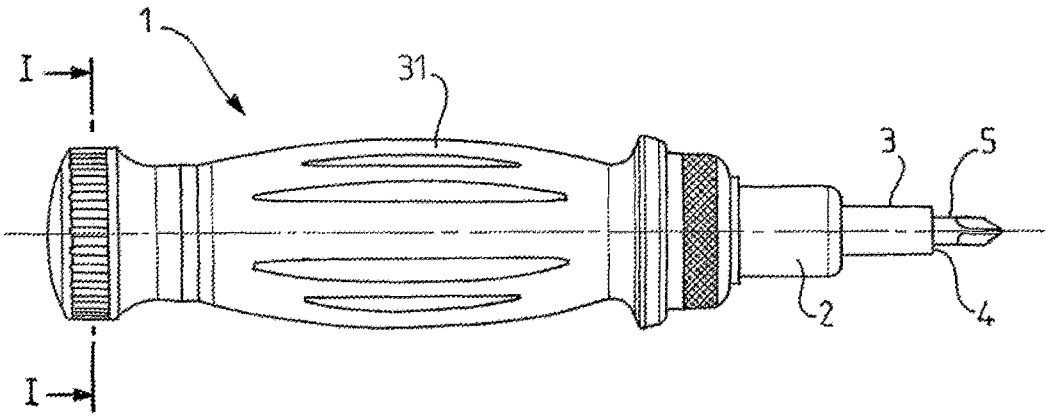
FIG. 1 is a side view of a handheld tool according to the invention.
Figure 2:
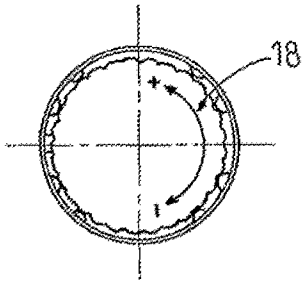
FIG. 2 is a rear view of the tool as illustrated on FIG. 1.

The invention relates to a handheld tool 1 for carrying out at least screwing/unscrewing and/or percussion operations, in particular on assembling means, such as screws, bolts or pins. The percussion operations can be boring, marking or still punching. The handheld tool 1 includes: at least one body 2 attached to a handle 31; a tool-carrier rod 3 for carrying an impression, in particular an insert corresponding to the operation performed, i.e. screwing, boring, marking, punching; and integrated means for imparting an axial percussion in the direction of the tool-carrier rod 3.

According to the invention, the shock rod 7 is provided inside the tool-carrier rod 3, capable of longitudinal movement relative to said tool-carrier rod 3, for directly imparting the percussion force to the impression 5.

According to the illustrated example, the body 2 is made of two tubular, in particular cylindrical parts $\mathbf{2}_1$, $\mathbf{2}_2$, and forms a cavity inside which the percussion mechanism is housed.

Both parts $\mathbf{2}_1$, $\mathbf{2}_2$ can be nested together. To that end, the rear portion $\mathbf{2}_2$ has an assembling edge 34 with an external shoulder fitted with a groove 36, wherein the front portion $\mathbf{2}_1$ of the body has an assembling edge 35 with an internal shoulder fitted with an orifice. An assembling pin 21 runs through the orifice and penetrates into the groove of the assembling edges 34, 35 to lock both parts $\mathbf{2}_1$, $\mathbf{2}_2$.

The internal and external shoulders of the assembling edges 34, 35 can enable, as illustrated, assembling and blocking of a washer 32 whose functions will be explained more at length later on acting in particular as a triggering cam but also as a bearing part for a recall spring 30.

The front portion $\mathbf{2}_1$ of the body 2 exhibits, at the level of a terminal end, a portion reinforced with a guiding orifice 36 for said tool-carrier rod 3. The body 2 receives additionally a shell formed of a tubular handle, in particular of flexible matter such as an elastomer easier grip on the handle.

The tool-carrier rod 3 includes at least over a length an outer diameter which is adjusted to slide into the guiding orifice 36 of the body 2. It has a longitudinal bore, sized for receiving the shock rod 7 and is terminated by an impression-carrier 4, in particular for removable attachment of an impression 5, such as in particular a cross-shaped or flat insert, a drift punch, a centre punch, a hollow punch.

The impression-carrier 4 comprises a bore with sizes matching the impression and receives a snap ring 37, in a groove, for holding the impression. Alternately, a small magnet can be substituted for the snap ring 37 for holding the impression 5.

The shock rod extends from the inside of the body 2, where it receives the percussion, up to the outside of the body in the immediate proximity of the impression. This rod 7 receives the percussion of the internal mechanism at the level of an anvil head 8 with widened section and transmits it to the back of the impression 5.

The integrated means 6 for imparting an axial percussion comprise: a trigger spring 9 and a lead 10, interdependent of said trigger, wherein said lead 10 is capable of moving axially in translation relative to said body 2 and relative to the shock rod 7 and of storing energy; and means for arming the lead and means for triggering the percussion.

The tool may additionally exhibit means 17 for adjusting the compression of the trigger spring 9, so as to adjust the intensity of the percussion, comprising at least one rotary knob 18 on the rear portion of the handle 31. More particularly, the means 17 for adjusting the spring compression may include, further, a screw 19/nut 20 system and means for guiding the nut 20 translationally along the longitudinal axis of said at least one body 2. The screw 19 is interdependent of the rotary knob 18, for driving the nut 20 translationally during the rotation of said knob. The nut 20 provides, directly or indirectly, a seat for the trigger spring 9.

Figure 4:
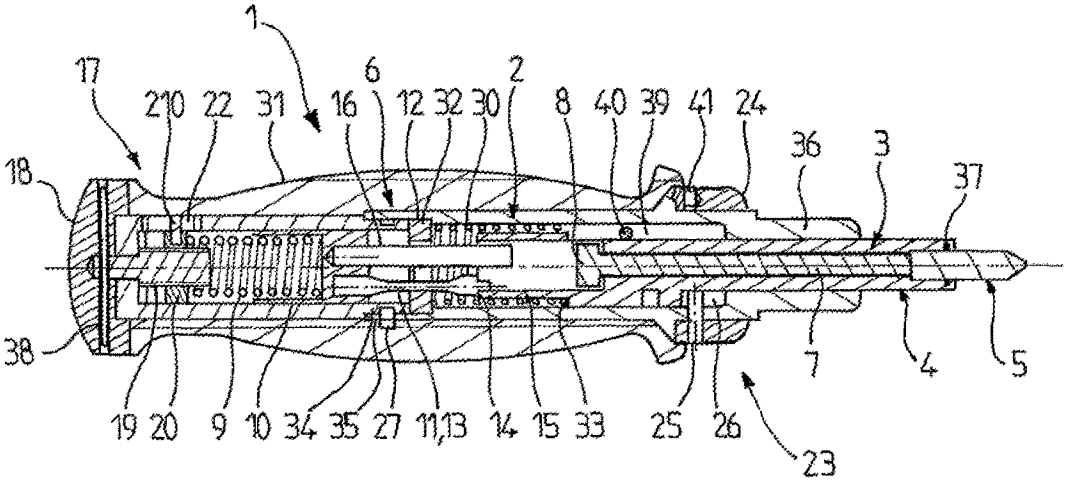
FIG. 4 is a view along section III-III as illustrated on FIG. 3.
Figure 3:
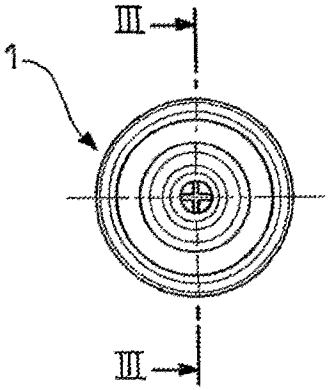
FIG. 3 is a view along section I-I as illustrated on FIG. 1.
Figure 5:
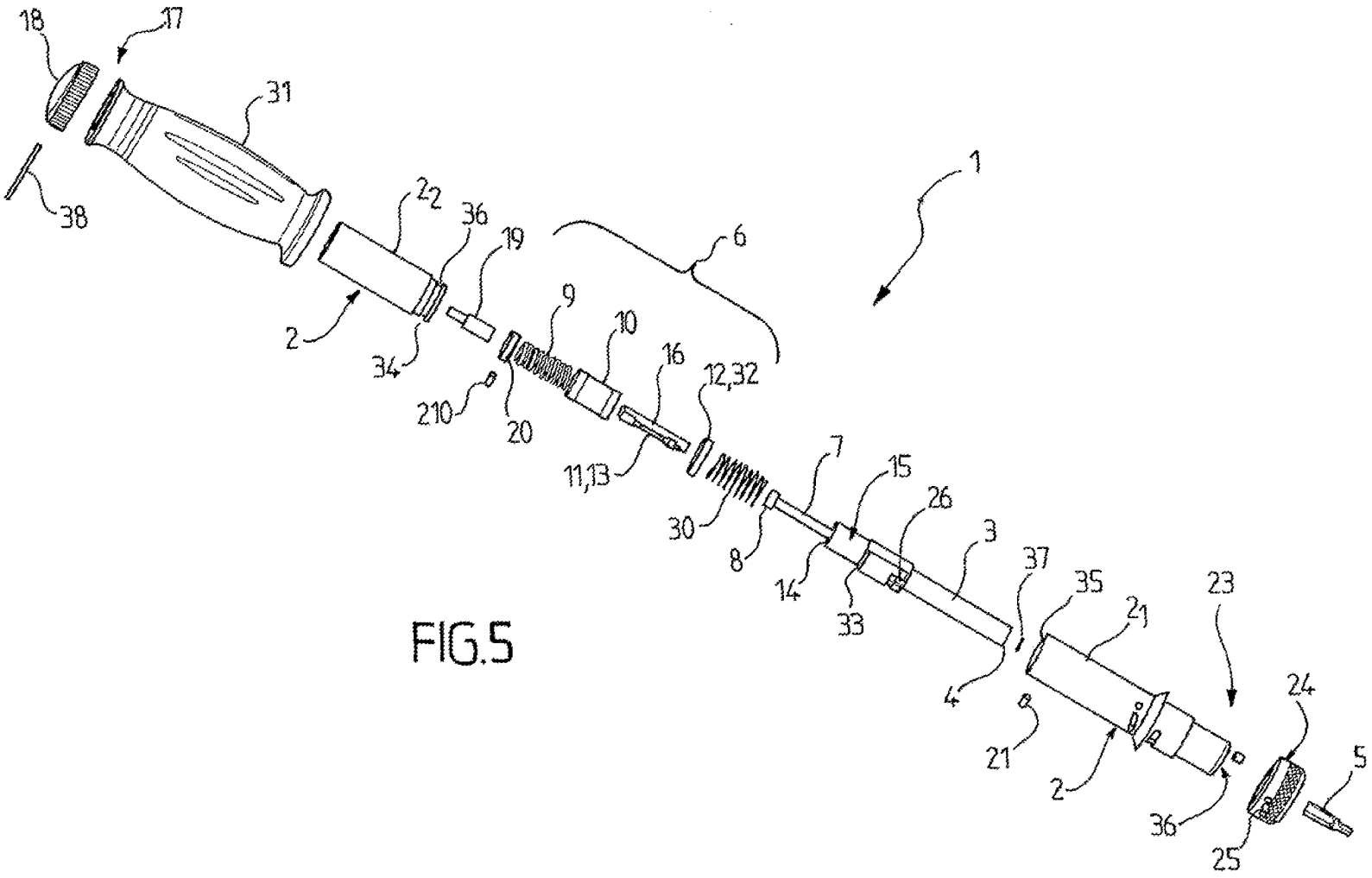
FIG. 5 is an exploded view of the handheld tool as illustrated on FIG. 4.
Figure 6:
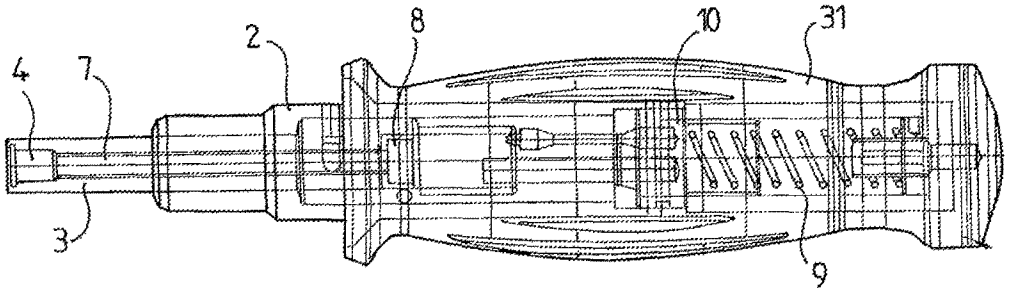
FIG. 6 is a partial view of the handheld tool, as illustrated on FIG. 1 in a resting position, that is to say non-armed.

More particularly, according to the illustrated example on FIG. 4, the screw 19 extends from the inside of the body 2 towards its outside, in particular through a bore of the portion $\mathbf{2}_2$ of the rear body. A spring pin 38, which is internal and connected rigidly relative to the knob 18, runs through a transverse bore of the screw 19 for assembling both its parts 18, 19.

Inside the body 2, the thread of the screw 19 engages into the internal screw thread of the nut 20 while an oblong hole 22 of the body 2, whose axis is parallel to the axis of the screw 19, guides a pin 210 of said nut 20 so as to prevent said nut from rotating relative to the body 2. Thus, the rotation of the knob 18, in one direction or the other, causes the nut to move forward or backward and hence allows adjusting the percussion intensity while increasing or reducing the compression of the trigger spring 9.

According to the invention, the means for arming the lead comprises the tool-carrier rod 3, provided for moving translationally relative to the body 2 and retractable stemming means 11, which are attached, on the one hand, to said tool-carrier rod 3 and on the other to said lead 10, wherein said means for triggering the percussion comprises means 12 for breaking up the stemming effect at the end of travel of said tool-carrier rod and thereby release the stored energy.

More particularly, as illustrated according to the embodiment, the stemming means 11 comprises a flection rod 13, which are attached rigidly to the lead 10, in particular nested in a bore, and to an arming stop 14, interlocked with said tool-carrier rod 3 and against which the flection rod 13 can stem.

The means 12 for breaking up the stemming effect comprises, according to this example, of a cam formed by the washer 32 which is attached to the body 2 and whose inside diameter is provided for engaging, at the end of travel of the tool-carrier rod 3, into the flection rod 13 to make it bend and thus release the arming stop 14.

As illustrated on FIG. 4 in particular, the tool-carrier rod 3 exhibits a cylindrical end 15 with a circular edge which forms the arming stop 14. The inner diameter of the washer 32 causes, at the end of travel of the tool-carrier rod 3, the flection rod 13 to bend inside the cylindrical portion 15 and thereby triggers the percussion.

A hammer 16, in particular cylindrical and attached to the lead 10, in particular received in a bore of the latter protrudes ahead of the flection rod 13 and is provided for striking the shock rod 7 inside said cylindrical end 15. It will be noted that the hammer 16 has a greater length than the flection rod, for striking the anvil head 8 of the rod 7, thereby preventing the stemming end of the flection rod 13 from striking the head 8.

We shall note besides that the body of the lead has a bore for embedding the hammer 16, as well as the stemming bore of the flection rod 13, on one of its sides, and a bore for receiving the trigger spring 9 on the other side, in particular with an inner diameter which is substantially equal, possibly slightly greater than the diameter of the spring 9.

When using the tool in so-called percussion mode, the operator locates the impression 5 of the tool on the surface to be struck and then exerts a pressure force on the handle, in the direction of the surface.

During this action, the tool-carrier rod 3 is translated relative to the body and drives, via the flection finger 13, the lead 10 as well as its hammer 16 while compressing the trigger spring 9.

Figure 7:
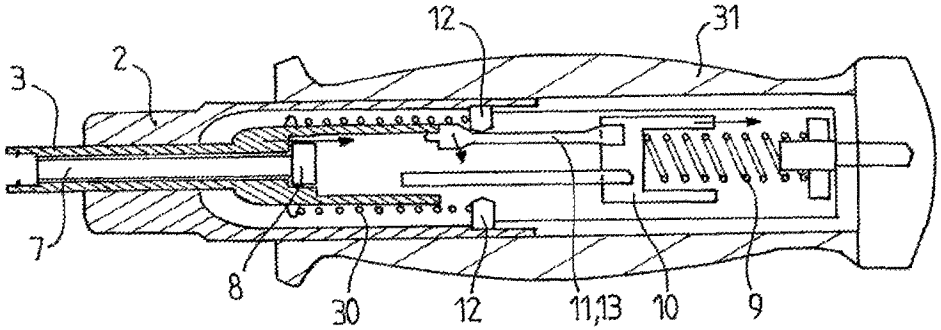
FIG. 7 is a partial view of the tool, along a longitudinal section illustrating the tool in an armed position, close to the triggering of the percussion.
Figure 8:
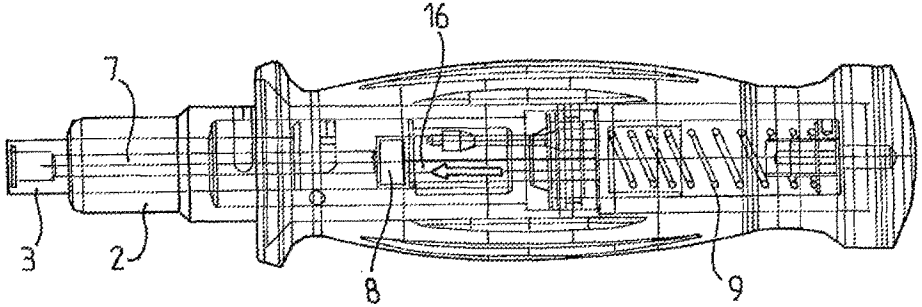
FIG. 8 is a partial view of the tool, when the hammer of the percussion mechanism strikes the anvil head of the shock rod.

As of a certain stroke of the tool-carrier rod 3, particularly illustrated on FIG. 7, the inner diameter of the washer 32 engages into the widened stemming end of the flection rod 13. The flection of the rod 13 releases said rod of the arming stop 14 inside the cylindrical end 15.

The stored energy is released, wherein the trigger spring 9 propels the lead 10 suddenly and more particularly its hammer 16 against the anvil head 8. The shock rod 7 then transmits the force directly on the rear portion of the impression 5.

So as to enable the flection rod 13 to come back into in an engaging position with the stemming stop 14, the integrated means 6 for imparting an axial percussion comprises, additionally, means 30 for recalling the tool-carrier rod 3 into a resting position relative to the body 2. These means are formed in particular of a recall spring, on the one hand, on the washer 32 then acting as a cam, and on a shoulder 33 of the tool-carrier rod 3, on the other hand.

The handheld tool can enable, according to an embodiment, screwing/unscrewing operations, in addition to the percussion operations.

To that end, the tool can in particular have means for preventing any rotation of said tool-carrier rod 3 relative to the body 2. According to the example of FIG. 4, these means can in particular be in the form of a pin 40, attached to the body 2 which is transverse to the longitudinal axis of the tool-carrier rod 3 and of a flat section 39 on a length of said tool-carrier rod 3. When the tool-carrier rod 3 is translated relative to the body 2, the pin 40 is in sliding contact on the flat section 39, thereby avoiding any rotation along the axis of the rod 3.

Additionally, the tool may exhibit control means 23 for blocking selectively said tool-carrier rod 3 in translation relative to the body 2, or conversely, allowing the translation of said tool-carrier rod 3 relative to the body 2, enabling selectively to use the handheld tool 1 for screwing/unscrewing or still percussion.

These means 23 can in particular include at least one selection ring 24 on the front of the handle. As illustrated on FIG. 4 in particular, a pin 25, interlocked with the selection ring 24, can co-operate with a groove 26 of said tool-carrier rod, parallel to the longitudinal axis of said tool-carrier rod 3.

Rotating the selection ring, causes the pin 25 to rotate, for locating the free end of the pin 25, either in the groove 26 so as to set said tool-carrier rod in translation relative to the body 2, and thereby to use the tool in percussion mode, or conversely extract the pin 25 from the groove 26 into a position in which the pin 25 blocks the translation of the tool-carrier rod 3.

The selection ring exhibits an indexing system, in our example, a ball 41 pressed by a spring, capable of co-operating according to two angular positions with two depressions of the body 2 for indexing both operating positions of the tool, namely a percussion mode or an screwing/unscrewing mode.

Naturally, other embodiments could have been contemplated by the man of the art without departing from the framework of the invention defined by the claims below.

I claim:

1. A handheld tool, for carrying out at least screwing/unscrewing and/or percussion operations for boring, marking, punching, in particular assembling means, such as screws, bolts, pins, comprising:

at least one body attached to a handle;

a tool-carrier rod for carrying an impression corresponding to the operation to be carried out; and integrated means for imparting an axial percussion in the direction of the tool-carrier rod, said integrated means comprising:

a trigger spring and a lead, interdependent of said trigger spring; and means for arming the lead and means for triggering the percussion, characterised in that:

the means for arming the lead comprises the tool-carrier rod, provided for moving in translation relative to the body and retractable stemming means, which are attached, on the one hand, to said tool-carrier rod and on the other to said lead, wherein said means for triggering the percussion comprises means for breaking up the stemming effect at the end of travel of the tool-carrier rod and thus release the stored energy;

a shock rod is provided inside the tool-carrier rod, capable of longitudinal movement relative to said tool-carrier rod, for directly imparting the percussion force to the impression, wherein said lead is capable of moving axially in translation relative to said body and relative to said shock rod of storing energy.

2. A handheld tool according to claim 1, wherein the shock rod has an anvil head intended for receiving the percussion.

3. A tool according to claim 1, in which said tool-carrier rod is terminated by an impression-carrier for removable attachment of an impression.

4. A tool according to claim 1, exhibiting means for adjusting the compression of the trigger spring, so as to adjust the intensity of the percussion, comprising at least one rotary knob on the rear portion of the handle.

5. A tool according to claim 4, in which the means for adjusting the compression of the trigger spring include, additionally, a screw nut system and means for guiding the nut translationally along the longitudinal axis of said at least one body, whereas the screw is interdependent of said rotary knob, for driving the nut translationally during the rotation of said knob, whereas the nut provides, directly or indirectly, a seat for the trigger spring.

6. A tool according to claim 1, exhibiting control means for selectively blocking the tool-carrier rod in translation relative to the body or, conversely, allowing the translation of said tool-carrier rod relative to said body, enabling selectively to use the handheld tool for screwing-unscrewing or still percussion, wherein said control means comprise at least one selection ring on the front of the handle.

7. A tool according to claim 1, in which the retractable stemming means comprises a flection rod, rigidly nested in a bore of the lead and of an arming stop, integral with the tool-carrier rod, and against which the flection rod can stem, wherein the means for breaking up the stemming effect comprises a cam formed of a washer which is attached to the body, and whose inside diameter is provided for engaging, at the end of travel of the tool-carrier rod, into the flection rod to make it bend and thus release the arming stop.

8. A tool according to claim 7, in which the tool-carrier rod has a cylindrical end whose circular edge forms the arming stop, whereas the inner diameter of said washer causes, at the end of travel of the tool-carrier rod, said flection rod to bend inside the cylindrical portion, wherein a hammer, attached to the lead, protrudes ahead of the flection rod, so as to strike said shock rod inside said cylindrical end.

9. A tool according to claim 1, in which the integrated means for imparting an axial percussion comprise, additionally, means for recalling the tool-carrier rod into a resting position relative to the body.

10. A tool according to claim 9, in which the means for recalling the tool-carrier rod comprises a recall spring bearing, on the one hand, on the washer then acting as a cam, and on a shoulder of the tool-carrier rod on the other hand.

* * * * *